US005480229A

United States Patent [19]

Thangsrirojkul

[11] Patent Number: 5,480,229

[45] Date of Patent: Jan. 2, 1996

[54] BAG FOR ALTERNATIVE USE

[75] Inventor: Onsri Thangsrirojkul, Bangkok, Thailand

[73] Assignee: IM International, Co., Ltd., Bangkok, Thailand

[21] Appl. No.: 263,054

[22] Filed: Jun. 21, 1994

[51] Int. Cl.[6] ..... B65D 30/10

[52] U.S. Cl. ..... 383/4; 383/120; 5/417

[58] Field of Search ..... 383/4, 120, 104; 5/417

[56] References Cited

U.S. PATENT DOCUMENTS

| | | | |
|---|---|---|---|
| 1,172,204 | 2/1916 | Gerhardstein | 383/4 X |
| 1,683,678 | 9/1928 | Kitterman et al. | 383/4 X |
| 2,831,624 | 4/1958 | Lever | 383/4 |
| 3,041,638 | 7/1962 | Lo Vico | 383/4 X |
| 3,073,367 | 1/1963 | Samara | 383/4 X |
| 3,976,113 | 8/1976 | Kim | 383/4 |
| 4,952,073 | 8/1990 | Wieland | 383/4 |
| 5,328,265 | 7/1994 | Clooney | 383/4 |

*Primary Examiner*—Jes F. Pascua

*Attorney, Agent, or Firm*—Merchant, Gould, Smith, Edell, Welter & Schmidt

[57] ABSTRACT

A device to be used alternatively as a bag and a mat comprises a piece of a flexible sheet material and releaseable fastening to confine said piece to the shape of a bottom with side walls which can be interconnected by edge connecting.

7 Claims, 3 Drawing Sheets

BAG FOR ALTERNATIVE USE

FIELD OF THE INVENTION

This invention relates to a device to be used alternatively as a bag and a mat.

BACKGROUND OF THE INVENTION

It is often desired to have a bag constructed so that it can be used not only for the intended purpose but also for an alternative purpose. For example, a nursing bag for travelling purposes can be used as a container for the necessary equipment for nursing babies and also as a nursing table. The pieces of different types of games may be stored in a container which is opened and made flat to be used as a playing board.

A simple bag comprising a folded integral piece of sheet material will not form a defined bottom but will rather have a pocket-like design. When transporting different items in such a bag the items in question will tend to be accumulated in the fold of the pocket. It is also more difficult to push down a large object into such a bag. On the other hand, if the bottom, integral with the bag, is constructed with some sort of reinforcement a playing mat formed by such a bag will no longer be flat when spread out on the ground, on a floor, or on another flat support.

SUMMARY OF THE INVENTION

An object of the invention is to provide a dual purpose device of the kind referred to, which overcomes the problems mentioned above.

Another object of the invention is to provide a device referred to which is of a simple construction and can be simply converted from a bag in three dimensions to a mat in two dimensions, and vice versa.

According to the invention there is provided a device to be used alternatively as a bag and a mat, comprising an integral piece of a flexible sheet material and having a shape which is substantially symmetrical in relation to a substantially central symmetry line, first fastening means disposed opposite each other on said symmetry line on said piece of sheet material, second fastening means disposed opposite each other on said symmetry line and spaced inwardly from said first fastening means, said first and second fastening means being constructed for releasable interengagement, and edge connecting means for releasable interengagement of the edges of said piece when folded along said symmetry line.

BRIEF DESCRIPTION OF THE DRAWINGS

In order to explain the invention in more detail reference is made to the accompanying drawing, in which.

DETAILED DESCRIPTION OF THE PREFERRED EMBODIMENT

Figure 1:
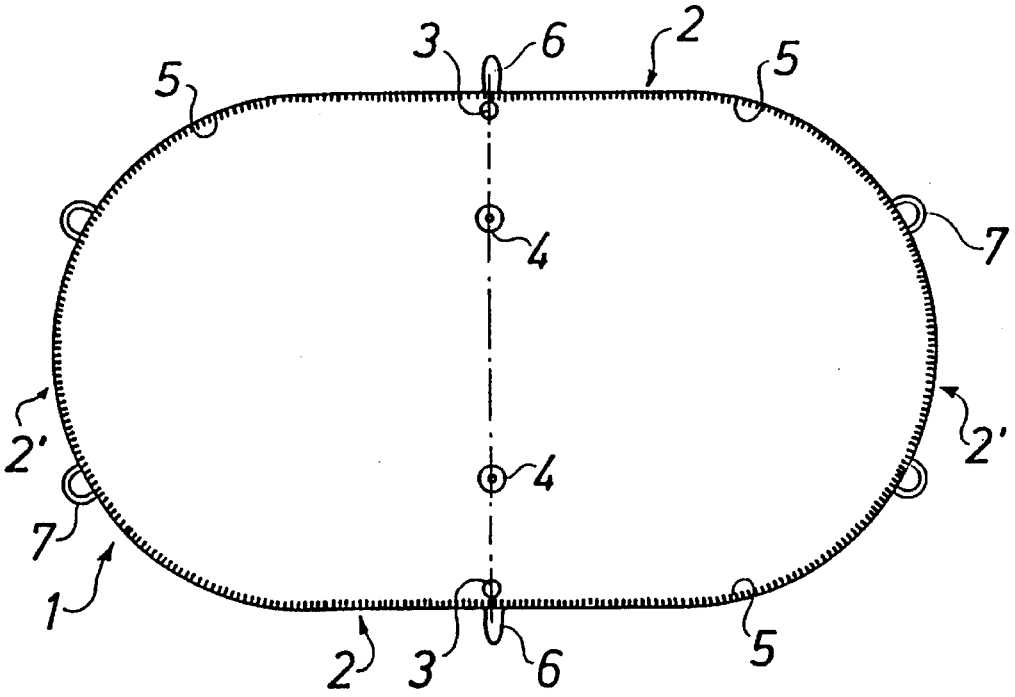
FIG. 1 is a plan view of an illustrative embodiment of the device of to the invention in the unfolded state thereof to be used as a playing mat.

The device shown in FIG. 1 comprises an integral piece 1 of a flexible sheet material. For the sake of simplicity, the shape piece 1 is in this embodiment outlined as substantially rectangular. The rectangular piece 1 has two longer opposite edges 2 and two shorter opposite edges 2', said latter edges preferably being curved as shown.

At each of the longer opposite edges 2, first fastening means 3 are disposed opposite each other one at each edge substantially centrally thereof. Spaced inwardly from said first fastening means 3 second fastening means 4 are also disposed opposite each other, said first and second fastening means being in line with each other and being constructed for releasable interengagement. The fastening means 3, 4 are preferably snap fasteners, but other types such as, for example, bur fasteners, buttons, and hooks can also be used.

The measures of the rectangular piece 1 are dependent on the measures of the bag. The distance between the first and second fastening means determines the width of the bottom of the bag, as will be explained below. The size of the bag and the measures of the bottom have to be chosen with regard to the size of the objects, e.g. toys, to be put into the bag.

Each of said two opposite edges 2 is boarded by the tracks 5 of a slide fastener including also a slide 6. The tracks 5 of each slide fastener join each other at said first fastening means 3 at the associated edge and extend in opposite directions therefrom. In the preferred embodiment the tracks 5 extend from said longer opposite edges 2 along said shorter curved opposite edges 2' and join each other therein.

At said two opposite shorter edges 2' handle attaching means 7 are disposed, said attaching means preferably comprise rings for snap shackles connected to straps.

Figure 2:
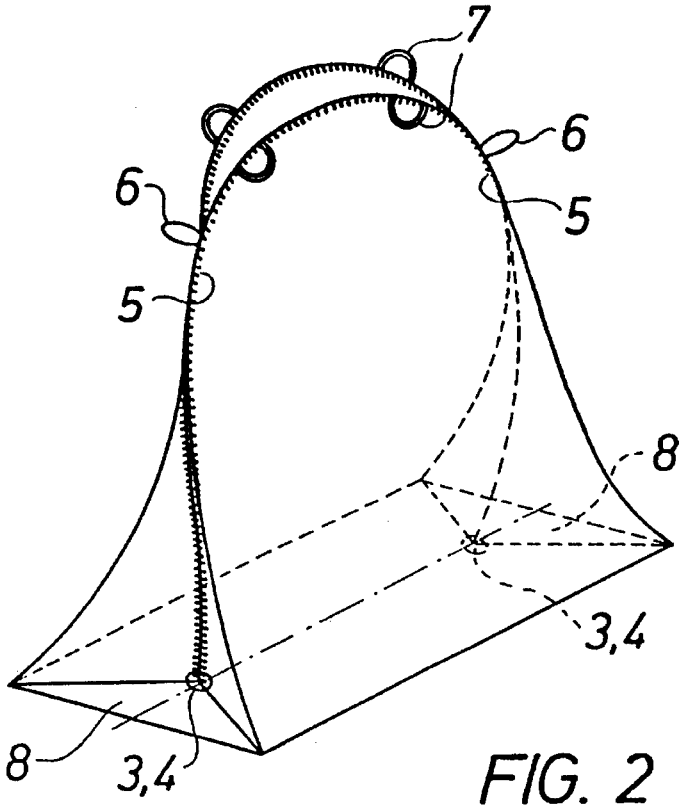
FIG. 2 is a perspective view of the device according to this embodiment when folded to form a bag.

When the device described to be used alternatively as a bag and a mat is transformed from a mat of FIG. 1 to a bag of FIG. 2 the first fastening means 3 at each of the two opposite edges 2 are drawn inwards to the inner second fastening means 4 for releasable interengagement therewith, i.e. the snap fasteners are snapped in place. This creates two wedges 8 which reinforce the bottom of the bag. Then, the integral piece 1 is folded upon itself and the edges of the sides of the bag formed are interconnected by means of the slide fasteners 5, 6 as shown in FIG. 2. For insertion of the items to be contained in the bag this can be opened up by displacing the slides along the tracks. The integral piece 1 can also have two straight shorter edges 2' as mentioned above and in this case the tracks 5 of the slide fasteners extend along the longer edges 2 to said shorter edges 2' and the opening formed can be covered with a lid which is integral with one edge 2' and can be releasably locked to the piece 1 at the other edge 2'.

The rings 7 for fastening straps in which the bag can be carried will be disposed at the upper part of the bag. The rings 7 relieve the pressure on the slide fasteners when the bag is carried.

The bag can be decorated on its outside with a design made to correspond to the items of the bag. For example, the design can be a playing mat including roads, blocks and junctions.

In order to use the bag as a mat the slide fasteners 5, 6 are unzipped, the first and second fastening means 3, 4 are released, and the integral piece 1 is flattened as a mat with decoration thereof facing upwards. In this way the bag is in a simple way transformed to a mat.

If the sheet material is too flexible and the desired bottom size of the bag too large instead of two sets of fastening means 3, 4 disposed in line four sets can be disposed in parallel and in line substantially centrally of the associoated edge 2.

Figure 3A:
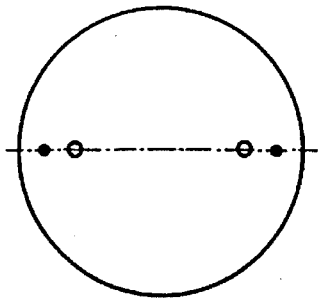
FIG. 3*a*, 3*c*, 3*e*, 3*g*, and 3*i* show alternative examples of different embodiments of the invention with the device in its unfolded state, and FIG. 3*b*, 3*d*, 3*f*, 3*h*, and 3*k*, respectively, the corresponding folded state of these embodiments.
Figure 3B:
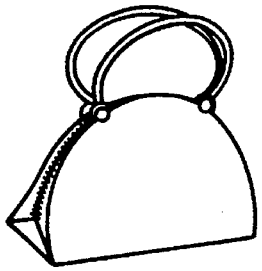
Figure 3C:
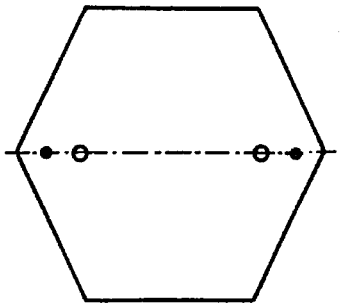
Figure 3D:
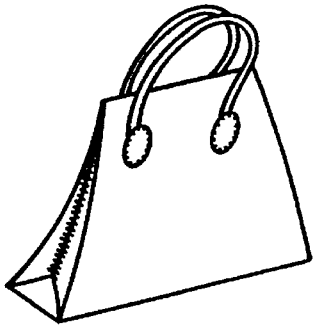
Figure 3E:
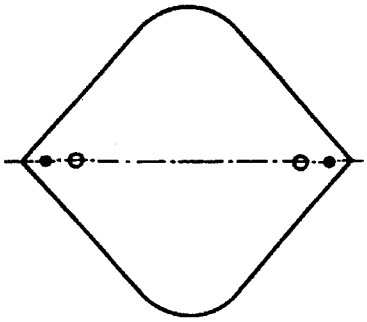
Figure 3F:
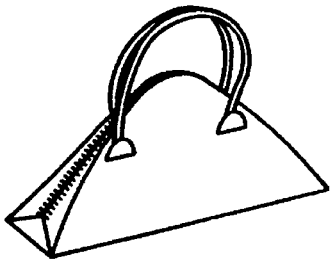
Figure 3G:
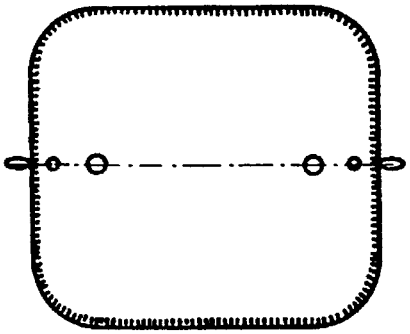
Figure 3H:
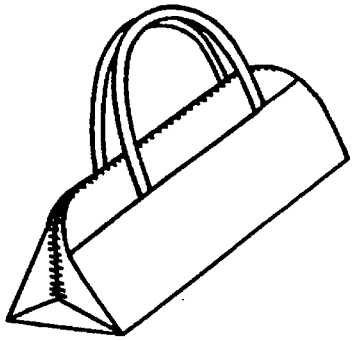
Figure 3I:
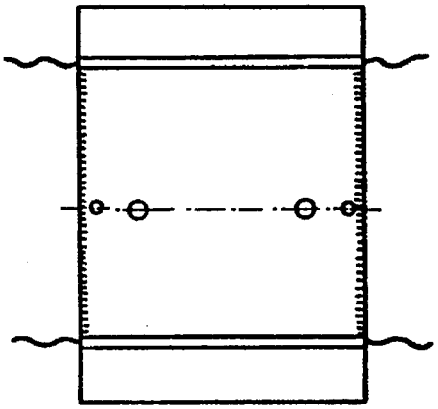
Figure 3K:
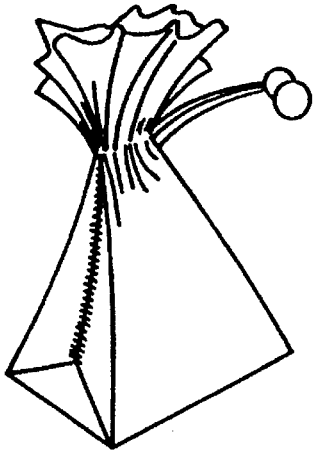

The shape of the integral piece 1 can vary and is mainly determined by the intended purpose of the playing mat. In FIG. 3*a*–3*k* examples of different emodiments of the inventions are shown and the reference numbering is for the sake of clarity omitted. In addition to a substantially rectangular shape the shape of the integral piece can also be a circle, as shown in FIG. 3*a*. In its folded state, this piece will with handle attaching means obtain the shape shown in FIG. 3*b*. A slight alteration of the rectangular shape of the integral piece according to FIG. 3*c* will result in a bag like that shown in FIG. 3*d*. The positioning of the fastening means, FIG. 3*e* and FIG. 3*g*, will result in bags of different designs, FIG. 3*f* and FIG. 3*h*, respectively. In FIG. 3*k*, a bag closed with strings is shown, which is formed from a piece as in FIG. 3*i*.

The device according to the invention can be manufactured in any suitable material. For example, plastic coated fabric can be used, as well as cotton, leather, canvas, polyester etc.

The bag for dual purpose can, of course, be used for any purpose where transport of items is required in combination with the need of a roughly rectangular flexible material in one piece. For example, the bag can be used for transporting cooking utensils and the unfolded piece can then be used as an apron with suitable decorations.

I claim:

1. A device to be used alternatively as a bag and a mat, comprising:

an integral piece of a flexible sheet material, said piece having a shape which is substantially symmetrical in relation to a substantially central symmetry line;

a first fastening element, disposed on each of two opposite sides of said piece of sheet material, being located on said symmetry line adjacent to an edge of each of said two opposite sides of said piece;

a second fastening element disposed on said each of said two opposite sides of said piece of sheet material for each said first fastening element, each second fastening element being spaced inwardly from the associated first fastening element along said symmetry line, each said first fastening element and each said second fastening element being constructed for releasable interengagement; and two slide fasteners, each including two tracks and a slide, said two tracks joining each other at each said first fastening element, respectively, and the two slide fasteners extending therefrom along a circumference of said piece of sheet material, said two tracks bordering the edge of each of said two opposite sides of said piece, each said slide connecting and disconnecting each said two tracks.

2. A device as in claim 1, wherein said first and second fastening elements comprise snap fasteners.

3. A device as in claim 1, wherein said first and second fastening elements comprise bur fasteners.

4. A device as in claim 1, wherein said integral piece has a substantially rectangular shape with said symmetry line ending at two opposite edges of said piece substantially centrally of said piece of sheet material.

5. A device as in claim 1, wherein said integral piece has a substantially rectangular shape with said symmetry line ending at two opposite corners of said piece of sheet material.

6. A device as in claim 1, wherein said integral piece has the shape of a circle with said symmetry line passing through a centre point of said circle.

7. A device as in claim 1, further comprising handle attaching means, the handle attaching means including a handle attaching element disposed on each of other two opposite sides of said piece of sheet material, each said handle attaching element being spaced from said symmetry line.

* * * * *